United States Patent [19]

Borowick

[11] 4,097,868

[45] Jun. 27, 1978

[54] ANTENNA FOR COMBINED SURVEILLANCE AND FOLIAGE PENETRATION RADAR

[75] Inventor: John Joseph Borowick, Bricktown, N.J.

[73] Assignee: The United States of America as represented by the Secretary of the Army, Washington, D.C.

[21] Appl. No.: 747,764

[22] Filed: Dec. 6, 1976

[51] Int. Cl.[2] ..... H01Q 21/00; H01Q 9/28; H01Q 19/10

[52] U.S. Cl. ..... 343/727; 343/795; 343/817; 343/834

[58] Field of Search ..... 343/725, 727, 729, 795, 343/800, 815, 816, 817, 818, 834

[56] References Cited

U.S. PATENT DOCUMENTS

| | | | |
|---|---|---|---|
| 2,745,102 | 5/1956 | Norgorden | 343/790 |
| 2,846,678 | 8/1958 | Best | 343/727 |
| 2,893,004 | 6/1959 | Kobler | 343/807 |
| 3,165,817 | 1/1965 | Teague | 343/817 |
| 3,193,830 | 7/1965 | Provencher | 343/729 |
| 3,394,379 | 7/1968 | Pickles | 343/800 |
| 3,482,248 | 12/1969 | Jones, Jr. | 343/725 |
| 3,550,135 | 12/1970 | Bodmer | 343/725 |
| 3,623,112 | 11/1971 | Rupp | 343/727 |

*Primary Examiner*—Alfred E. Smith
*Assistant Examiner*—Harry Barlow
*Attorney, Agent, or Firm*—Nathan Edelberg; Jeremiah G. Murray; Edward Goldberg

[57] ABSTRACT

An L-band radar and antenna array operating with an existing X-band surveillance radar to provide a foliage penetration capability. The foliage penetration antenna consists of an array of L-band, stripline dipole/director elements placed in front of an array of broadwall waveguide slots which define an X-band aperture. The X-band aperture in addition to its own function, serves as a reflector for the dipole/director elements. Aperture sharing is thus provided for a dual frequency antenna without increasing the size of the existing X-band aperture.

12 Claims, 9 Drawing Figures

MEASURED RADIATION PATTERN, L-BAND ARRAY 1250 MHz, ELEVATION (H) PLANE

MEASURED RADIATION PATTERN, L-BAND ARRAY 1250 MHz, AZIMUTH (E) PLANE

—— SUM FEED

---- DIFFERENCE FEED

MEASURED RADIATION PATTERN,
X-BAND ANTENNA WITH L-BAND
ANTENNA IN PLACE

MEASURED RADIATION PATTERN, X-BAND APERTURE WITHOUT L-BAND ANTENNA IN PLACE

ANTENNA FOR COMBINED SURVEILLANCE AND FOLIAGE PENETRATION RADAR

The invention described herein may be manufactured and used by or for the Government for governmental purposes without the payment of any royalties thereon or therefor.

CROSS REFERENCE TO RELATED APPLICATION

The present invention is related in U.S. Ser. No. 747,765, filed Dec. 6, 1976, entitled "L-Band Radar Antenna Array," the inventor being John Borowick, the present applicant, which application is also assigned to the assignee of the subject invention.

BACKGROUND OF THE INVENTION

This invention relates generally to radar apparatus for military applications, and more particularly to a dual frequency aperture sharing antenna adapted for both surveillance and foliage penetration applications.

One of the basic deficiencies of conventional short range microwave surveillance radars operating at X-band is their inability to penetrate even moderate foliage. Accordingly, it is an objective of the present invention to combine an L-band foliage penetration array with an existing X-band surveillance radar antenna without appreciably adding to the size of or weight of the X-band structure.

SUMMARY

Briefly, the subject invention is directed to a dual frequency aperture sharing antenna configuration comprised of a flat plate array of broadwall waveguide slots operable with radar apparatus of a first operating frequency in front of which is mounted a plurality of stripline dipole elements each having a passive director operative with radar apparatus of a second operating frequency wherein the flat plate array serves as a reflector for the stripline dipole elements when operating at the second operating frequency. The stripline dipole elements, however, are arranged such that little interference is provided to the flat plate array during operation at the first operating frequency. The combined array is further adapted to be mounted on a light weight tripod and mechanically scanned in azimuth. The stripline elements additionally can be folded up against the flat plate array for protection during transport.

DESCRIPTION OF THE PREFERRED EMBODIMENT

Figure 1:
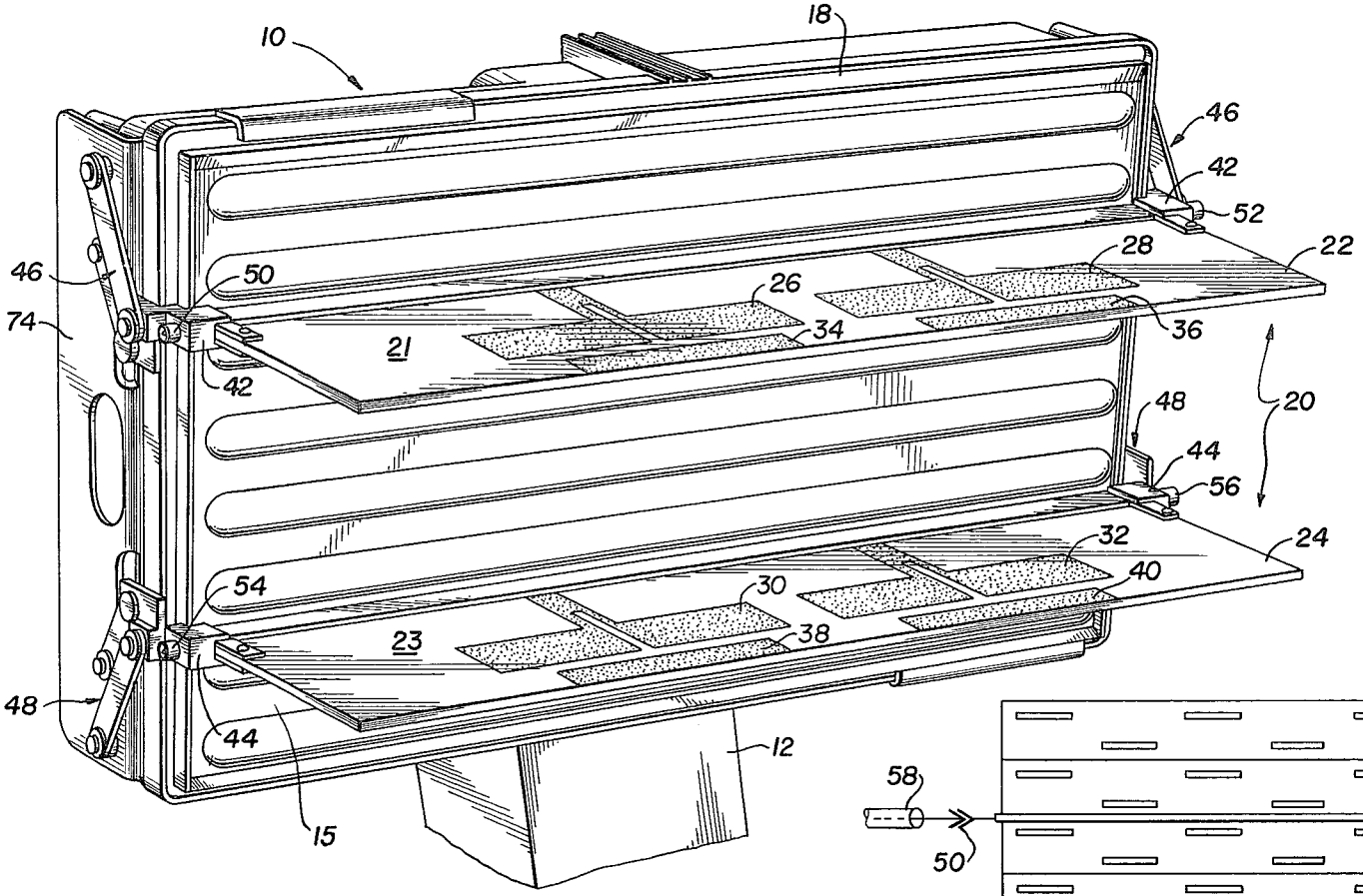
FIG. 1 is a perspective view of the preferred embodiment of the subject invention.
Figure 2:
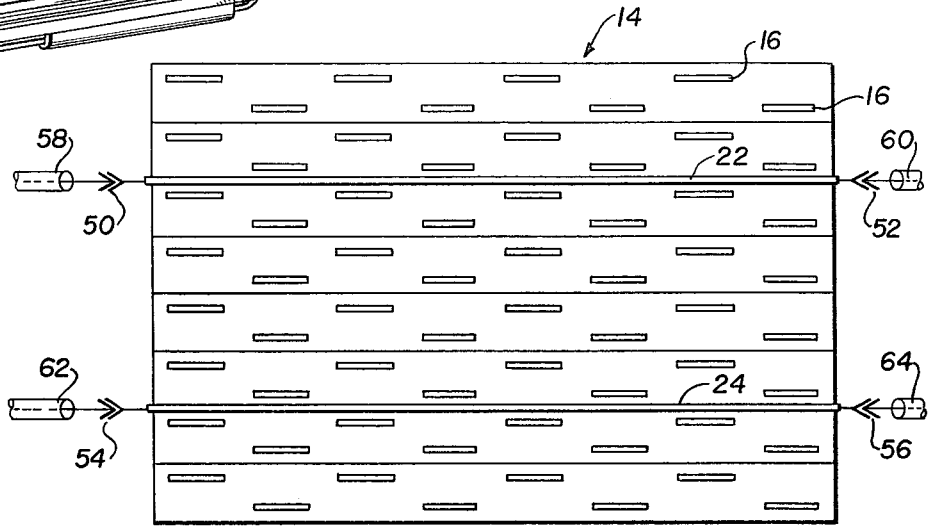
FIG. 2 is a diagram illustrative of the mutual relationship of the waveguide slot array and the stripline dipole/director array provided for the configuration shown in FIG. 1.

Referring now to the drawings, and more particularly to FIG. 1, reference numeral 10 designates an enclosure which is adapted to include separate or combined radar apparatus for generating signals at two separate and distinct operating frequencies, the first being in the X-band range for surveillance radar applications, while the second is in the L-band range for foliage penetration applications. The radar enclosure 10 is mounted upon a base 12 which is adapted to be affixed to a pedestal e.g. a tripod, not shown, so that the entire assembly can be mechanically scanned in azimuth. No electronic or mechanical scan is provided in elevation but could be if desired. A flat plate waveguide slot array 14 comprised of broadwall slots 16 shown diagrammatically in FIG. 2 is protected by a microwave permeable face plate 15 mounted on the front wall portion 18 of the enclosure 10. The X-band slot array 14 is center fed from a waveguide corporate feed, not shown, at the rear of the array and is adapted to radiate with vertical polarization in the scan plane when operating in the surveillance mode.

In an effort to provide a foliage penetration capability without appreciably adding to the size and weight of the X-band radar, FIG. 1 additionally discloses an L-band (1220–1280MHz) radar antenna array 20 preferably but not limited to two sets of antenna elements 21 and 23 fabricated on separate dielectric cards or sheets 22 and 24. Each sheet includes a pair of L-band stripline dipole antenna elements 26 and 28 and 30 and 32, respectively, together with forwardly located respective stripline passive director elements 34, 36, 38 and 40. The L-band elements 21 and 23 are mounted mutually horizontally across the face plate 15 and projected outwardly therefrom intermediate the X-band slots 16 so that none of the slots 16 are physically blocked during operation. The position and spacing of the elements 21 and 23 are such as to be preferably symmetrical with respect to the elevation centerline of the X-band aperture. It should be noted, however, that when desirable a single set of elements can be utilized when located on the elevation centerline, or three sets of elements can be utilized with one set located at the centerline and the other two at upper and lower edges of the aperture. The dielectric sheets 22 and 24 including the dipole/passive director elements are respectively attached to mounting assemblies which include members 42 and 44 attached to mechanical lever means 46 and 48, which permits collapsing of the L-band array against the face plate 15 so as to protect the L-band elements 21 and 23 from damage when not in use such as when the radar is being moved from one location to another. The mounting members 42 and 44 are attached at each rear edge of the dielectric sheets 22 and 24 and include an integrated stripline to coaxial RF connector. More particularly, the mounting members 42 attached to the dielectric sheet 22 includes RF connector 50 at one end and RF connector 52 at the other end. In a like manner, mounting members 44 attached to the dielectric sheet 24 includes connector 54 and 56 at opposite ends. This arrangement is shown schematically in FIG. 2, with each of the connectors 50, 52, 54 and 56 having respective coaxial cables 58, 60, 62 and 64 connected thereto for being coupled to the L-band radar apparatus inside of the enclosure 10.

Figure 3:
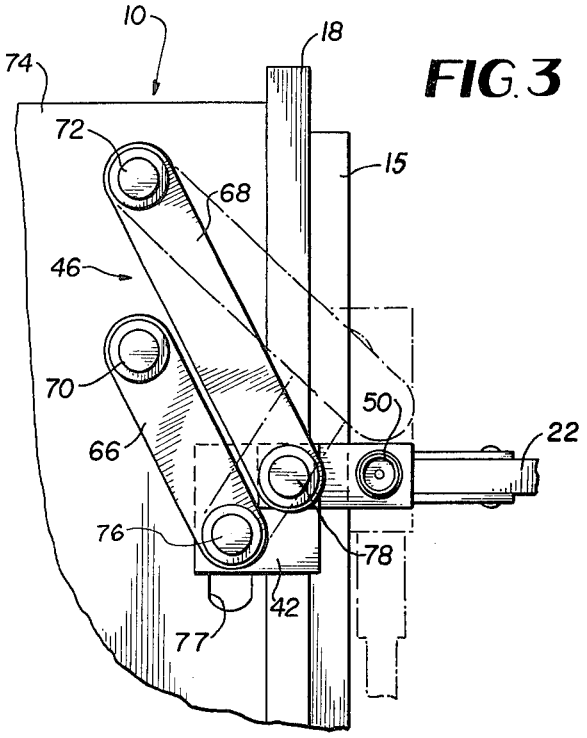
FIG. 3 is a partial side plan view illustrative of the means for folding the stripline dipole/director array against the face of the waveguide slot array shown in FIG. 1.

Prior to discussing the electrical circuitry in further detail, reference will now be made briefly to FIG. 3, wherein the mechanical means comprising the lever assembly 46 is shown for purposes of illustration inasmuch as the other lever assembly 48 is identical except that it is arranged such that the dielectric sheet 24 is adapted to collapse upwardly whereas the dielectric sheet 22 shown in FIG. 3 is adapted to collapse downwardly. The lever assembly 46 is comprised of two pivoted links 66 and 68 having one end respectively connected to the pivots 70 and 72 on the side wall 74 of the enclosure 10 while the opposite ends are connected to pivots 76 and 78 on the mounting member 42. The pivot 76 furthermore engages a slot 77 in the side wall 74 such that its movement is constrained to a vertical movement while pivot 78 forces the member 42 to translate forwardly while rotating downwardly so that the dielectric sheet 22 lies close to the wall 16 when folded downwardly. With this type of mechanism there are no RF connections or disconnections necessary when folding or unfolding the L-band antenna array. Additionally, the mechanical elements do not interfere with the performance of the antenna array.

Figure 4:
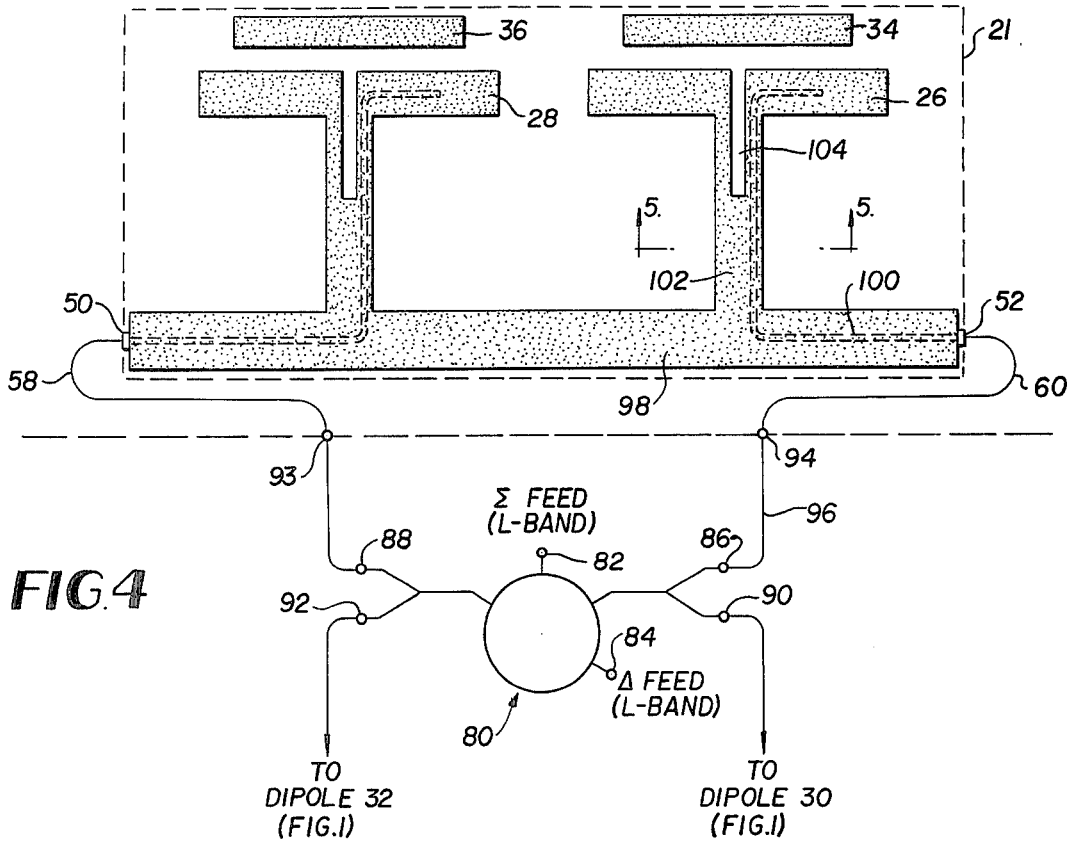
FIG. 4 is an electrical schematic diagram illustrative of the microwave feed circuit for the arrangement shown in FIG. 1.
Figure 5:
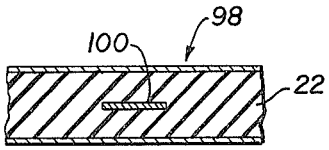
FIG. 5 is a fragmentary cross-sectional view of FIG. 4 taken along the lines of 5—5 thereof.

The manner in which the L-band stripline dipole/director elements 21 and 23 are fed is shown schematically in FIG. 4. A stripline hybrid ring and matching circuit 80 located within the enclosure 10 includes two ports 82 and 84 respectively adapted for connection to the sum and difference microwave feeds of L-band radar apparatus in a manner well known to those skilled in the art. The ports 82 and 84 are thus coupled to the four ports 86, 88, 90 and 92. The ports 86 and 88 are adapted to feed the stripline dipole elements 26 and 28, respectively, while the ports 90 and 92 are adapted to feed the stripline dipole elements 30 and 32 as shown in FIG. 1. The port 86, for example, couples to an enclosure bulk-head RF connector 94 by means of a coaxial transmission line 96, which in turn connects the stripline to coaxial connector 52 integral with the mounting member 42 (FIG. 1). The connector 52 connects to a stripline transmission line 98, which includes an inner conductor 100 shown in FIG. 5 which takes a 90° radius bend and then extends beneath the stripline section 102 which includes a stripline balun portion 104 to excite the dipole 26.

Figure 7:
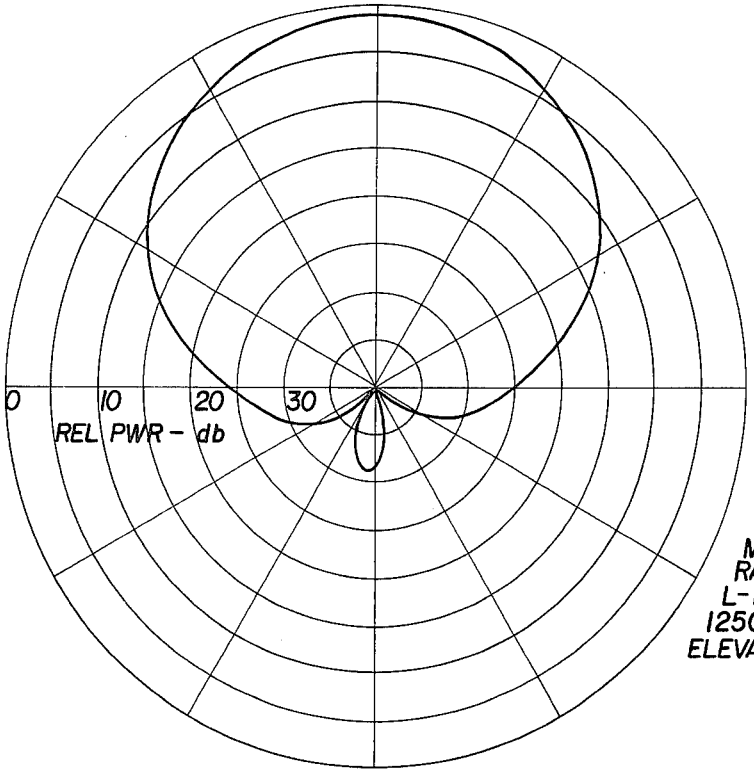
FIG. 7 is a diagram illustrative of the measured radiation pattern of the stripline/dipole array in place for the elevation plane.
Figure 6:
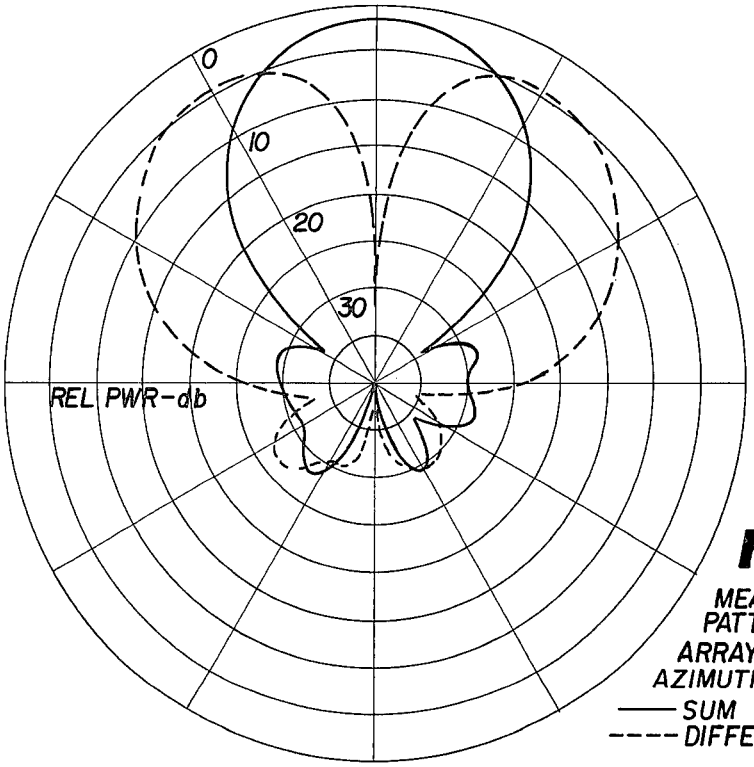
FIG. 6 is a diagram of the measured radiation pattern of the stripline/dipole array for both sum and difference feeds in the azimuth plane.
Figure 8:
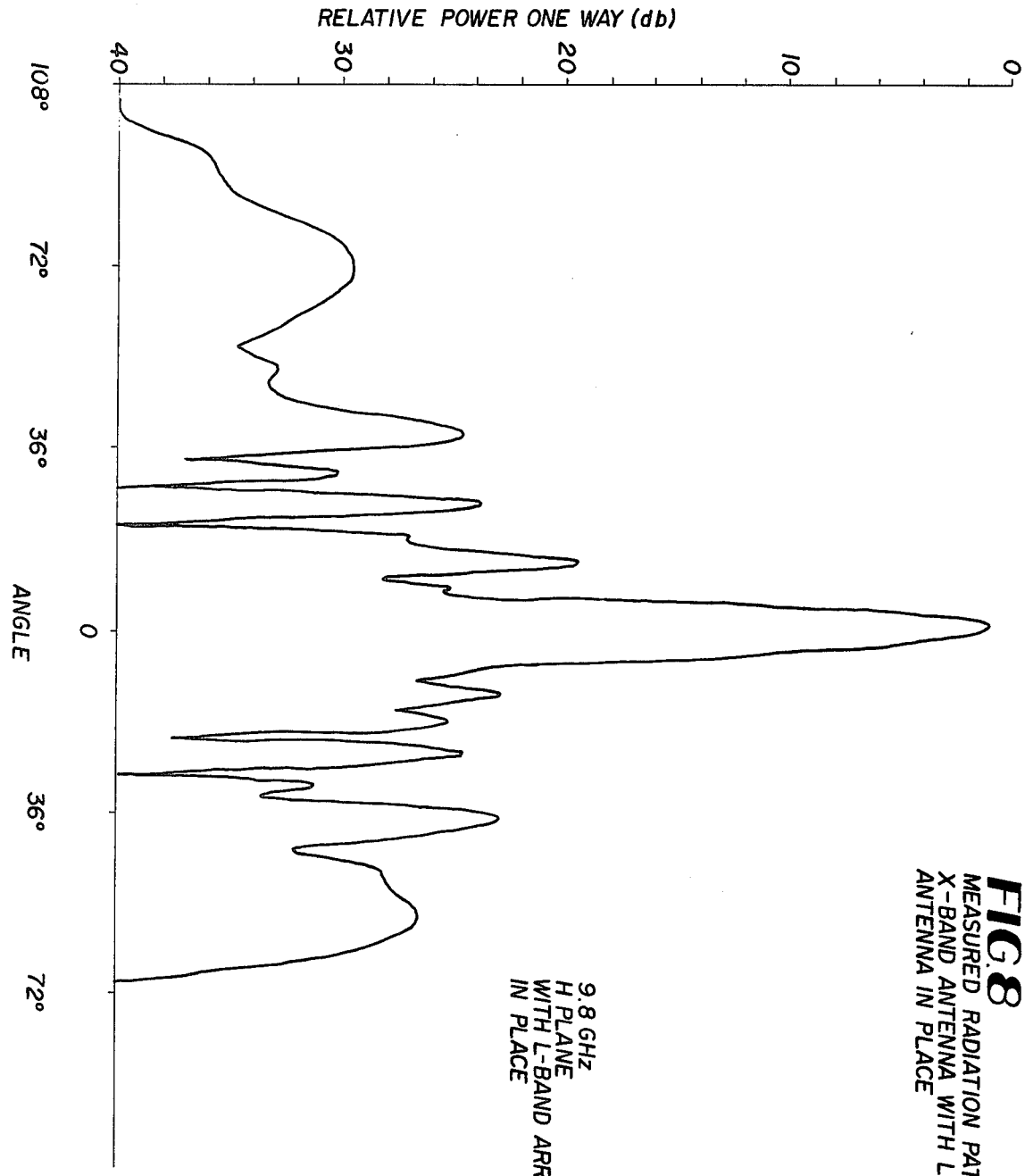
FIG. 8 is a graph illustrative of the measured radiation pattern of the waveguide slot array with the stripline/dipole array in place.
Figure 9:
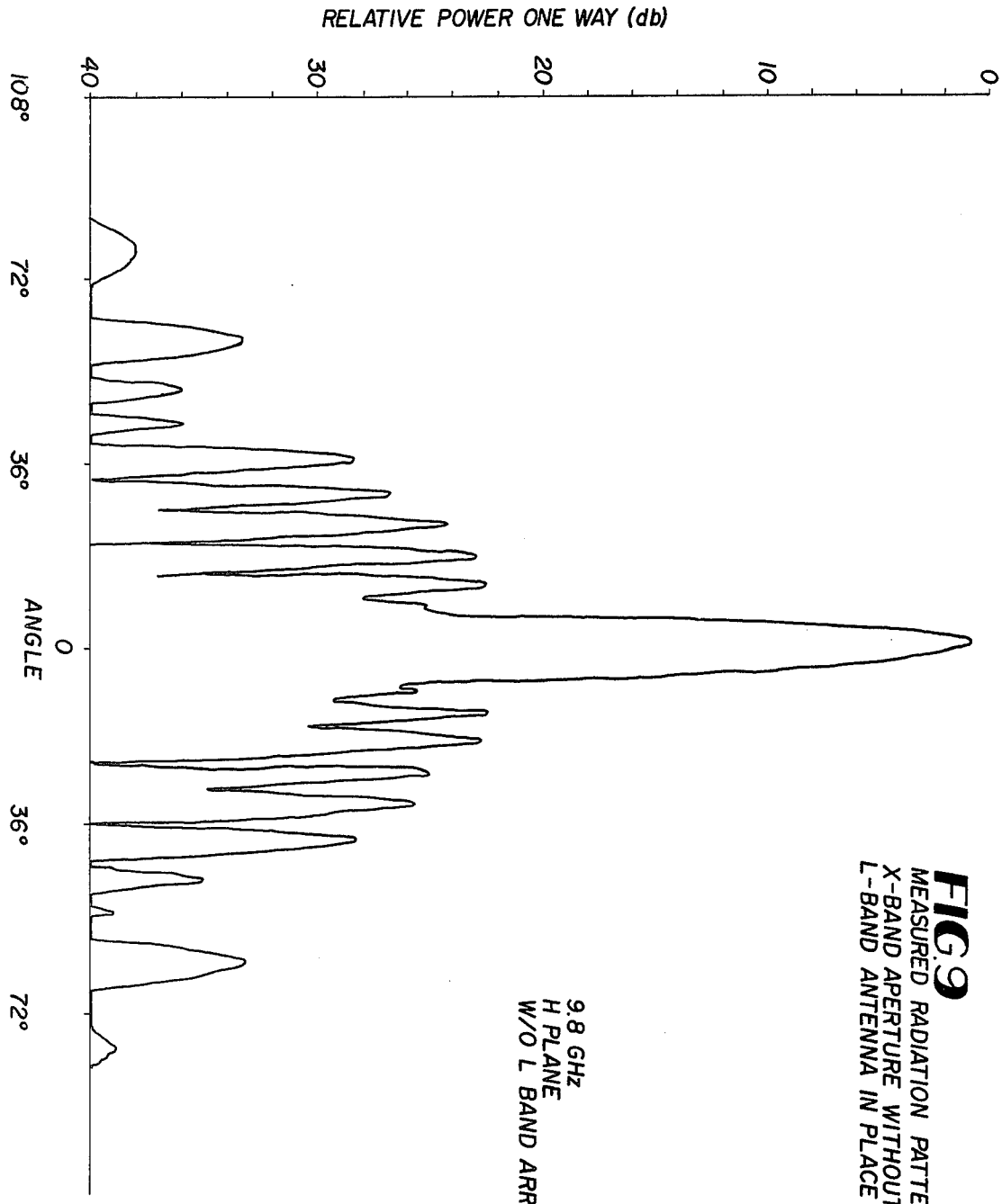
FIG. 9 is a graph of the measured radiation pattern of the waveguide slot array without the stripline/dipole array in place.

In operation, the L-band array comprised of the two sets of stripline elements 21 and 23 utilizes the X-band array 14 as a reflector when operating in the foliage penetration mode. The L-band dipole/director elements as shown in FIG. 1 provides horizontally polarized phase monopulse microwave energy in azimuth over a 1220–1280MHz frequency range. FIG. 6, moreover, shows the sum and difference excitation modes plotted in polar log form for the center L-band frequency of 1250MHz when arranged as shown in FIG. 1. The difference feed pattern lobes are essentially the same i.e. they have pattern symmetry while maintaining a deep null at 0° azimuth. The elevation pattern of te L-band array is shown in FIG. 7. The commonality of the L-band dipole/director elements together with the X-band aperture moreover results in the gain of the L-band array being increased. The X-band radiation characteristics, on the other hand, are only minimally effected with the L-band array in place, as evidenced by FIGS. 8 and 9.

Thus what has been shown and described is a dual frequency aperture sharing antenna system wherein two separate antennas for separate microwave bands are utilized in such a manner that both are adapted to operate with little interference from the other. More particularly, however, there is disclosed the use of a passive stripline director element in combination with a stripline dipole antenna element in front of an X-band aperture which acts as the ground plane for the dipole/director elements.

Having thus disclosed and described what is at present considered to be the preferred embodiment of the subject invention,

I claim:

1. An aperture sharing radar antenna for first and second radar apparatus operative in different frequency bands comprising in combination:

a first radar antenna array including a plurality of waveguides having front and side walls coupled to and operable with said first radar apparatus in one frequency band, the front walls of said waveguides having a plurality of substantially parallel rows of multiple slots arranged along said front walls in a common plane; and a second radar antenna array coupled to and operable with said second radar apparatus in another frequency band, said second array including a planar dielectric sheet and a stripline dipole element on said sheet operatively mounted transversely to said common plane along the front of said first radar antenna array extending parallel to and spaced from said multiple slots to avoid obstruction thereof and cause negligible interference to the effective operation of said first radar apparatus, said first antenna array acting as a reflector for said second antenna apparatus during operation of said second radar apparatus.

2. The radar antenna as defined in claim 1 wherein said first array of multiple slots are commonly excited by said first radar apparatus, and wherein said second antenna array comprises first and second planar dielectric sheets and a plurality of stripline dipole elements formed on said dielectric sheets, said sheets being mounted intermediate mutually adjacent selected rows of slots, said dipole elements being individually excited by said second radar apparatus.

3. The radar antenna as defined by claim 2 wherein said stripline dipole elements additionally include respective adjacent stripline passive director elements on said sheets.

4. The radar antenna as defined by claim 2 wherein two of said dipole elements are formed on said first dielectric sheet and another two stripline dipole elements are formed on said second dielectric sheet, said second dielectric sheet being mounted at a predetermined distance away from said first dielectric sheet between respective selected adjacent rows of slots, and wherein said another two dipole elements are separately excited by said second radar apparatus.

5. The radar antenna as defined by claim 4 and additionally including respective passive stripline director elements formed in front of all said stripline dipole elements.

6. The radar antenna system as defined by claim 5 wherein said slot array comprises an X-band waveguide slot array and wherein said stripline dipole and director elements comprise L-band elements.

7. The radar antenna as defined by claim 6 wherein said X-band waveguide slot array comprises a plurality of broadwall slots in horizontal wave guides providing vertical polarization of microwave energy radiated therefrom and wherein said L-band stripline dipole elements are mounted for radiating horizontally polarized microwave energy.

8. The radar antenna as defined by claim 1 and additionally including pivotable mounting means positioning said second array in a first attitude transverse to said plane of said first array during the operating mode of said second radar apparatus and positioning said second array in a second attitude substantially parallel to said first array during a nonoperative mode of both said first and second radar apparatus.

9. The radar antenna as defined by claim 1 wherein said second antenna array additionally includes folding means operable to fold said second antenna array against said first antenna array during the non-operative modes of said first and second radar apparatus.

10. The radar antenna as defined by claim 9 wherein said folding means additionally includes electrical RF connector means whereby radar signals for said second radar apparatus are coupled to and from said second radar antenna array.

11. The radar antenna as defined by claim 10 wherein said second radar antenna array comprises a stripline dipole array adapted for foliage penetration radar operation including transmission line means coupled to said RF connector means and wherein said folding means includes a mechanical lever assembly adapted to pivot the dielectric sheet from said position transverse to said plane of said first antenna array to a position substantially parallel to the plane of said first array.

12. The radar antenna as defined by claim 11 and additionally including a housing incorporating said first and second radar apparatus therein and wherein said mechanical lever assembly is mounted on the outside of said housing.

* * * * *